US007422553B2

(12) United States Patent
Prüm

(10) Patent No.: US 7,422,553 B2
(45) Date of Patent: Sep. 9, 2008

(54) GRIPPER CYLINDER IN A FOLDING APPARATUS

(75) Inventor: Sebastian Alois Prüm, Kaiserslautern (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 189 days.

(21) Appl. No.: 10/573,574

(22) PCT Filed: Sep. 23, 2004

(86) PCT No.: PCT/EP2004/052282

§ 371 (c)(1),
(2), (4) Date: Mar. 27, 2006

(87) PCT Pub. No.: WO2005/032989

PCT Pub. Date: Apr. 14, 2005

(65) Prior Publication Data

US 2007/0042888 A1 Feb. 22, 2007

(30) Foreign Application Priority Data

Sep. 27, 2003 (DE) ..... 103 44 950

(51) Int. Cl.
*B31F 1/08* (2006.01)

(52) U.S. Cl. ..... 493/424; 493/426; 493/434; 493/436

(58) Field of Classification Search ..... 493/424, 493/426, 434, 435, 436
See application file for complete search history.

(56) References Cited

U.S. PATENT DOCUMENTS

| | | | | |
|---|---|---|---|---|
| 953,063 | A | 3/1910 | Sheldon | |
| 3,758,102 | A * | 9/1973 | Munn et al. | 493/342 |
| 5,004,451 | A | 4/1991 | Prum | |
| 5,429,578 | A | 7/1995 | Calbrix et al. | |
| 5,484,379 | A | 1/1996 | Stab | |
| 5,503,071 | A | 4/1996 | Hillebrand et al. | |
| 5,697,881 | A * | 12/1997 | Nishihara | 493/429 |
| 5,839,366 | A | 11/1998 | Schaede | |
| 6,071,224 | A * | 6/2000 | Lanvin et al. | 493/422 |
| 6,093,139 | A | 7/2000 | Belanger | |

(Continued)

FOREIGN PATENT DOCUMENTS

| | | |
|---|---|---|
| DE | 43 40 858 | 2/1998 |

(Continued)

*Primary Examiner*—Hemant M. Desai
(74) *Attorney, Agent, or Firm*—Jones Tullar & Cooper, PC

(57) ABSTRACT

A cylinder, which is part of a folder, includes a cylinder body with at least one gripper that can be moved between a retracted position within the cylinder body; an extended position, and a clamping position in which a tip of the gripper presses flat material against a surface section of the cylinder body. A pivot axis, about which the gripper pivots between its retracted position and its extended position, is within the cylinder body. A counterthrust element, which cooperates with a separate cutting blade, to cut the flat material which is to be gripped by the gripper, is associated with the cylinder body. The gripper is situated upstream of the counterthrust element, in the rotational direction of the gripper cylinder. A second axis, about which the gripper moves in the peripheral direction of the cylinder, is also provided. Both of these axes are fixed in relation to the cylinder.

14 Claims, 10 Drawing Sheets

U.S. PATENT DOCUMENTS

| | | | | |
|---|---|---|---|---|
| 6,159,138 | A | 12/2000 | Lanvin et al. | |
| 6,251,053 | B1 | 6/2001 | Lanvin et al. | |
| 6,652,437 | B1 | 11/2003 | Bergeron et al. | |
| 6,659,008 | B2 | 12/2003 | Mutschall et al. | |
| 2007/0167305 | A1* | 7/2007 | Ratz et al. | 493/432 |

FOREIGN PATENT DOCUMENTS

| | | | |
|---|---|---|---|
| DE | 198 57 507 | | 7/1999 |
| DE | 100 60 713 | | 9/2001 |
| DE | 102 03 059 | | 8/2002 |
| EP | 0 769 376 | | 10/1996 |
| EP | 0 931 748 | | 1/1999 |
| EP | 1 203 742 | A1 | 5/2002 |
| GB | 1 214 339 | | 12/1970 |
| GB | 325951 | | 3/1980 |

* cited by examiner

GRIPPER CYLINDER IN A FOLDING APPARATUS

CROSS-REFERENCE TO RELATED APPLICATIONS

This patent application is the U.S. National Phase, under 35 USC 371, of PCT/EP2004/052282, filed Sep. 23, 2004; published as WO 2005/032989 A1 on Apr. 14, 2005, and claiming priority to DE 103 44 950.7, filed Sep. 27, 2003, the disclosures of which are expressly incorporated herein by reference.

FIELD OF THE INVENTION

The present invention is directed to a cylinder of a folding apparatus, having a cylinder body and at least one gripper. The at least one gripper is movable between a non-use position, lowered into the cylinder body, an extended position and a clamping position.

BACKGROUND OF THE INVENTION

A gripper cylinder, which has one or several grippers on its shell face, which grippers are movable between a position in which they keep a leading edge of a piece of flat material, which is to be conveyed on the gripper cylinder, pressed against the shell face, and a release position, in which the flat material can be released again, or a fresh piece of flat material can be picked up and clamped, is generally known. The grippers typically perform a pivot movement between these two positions. Since the periods of time available for accomplishing such clamping or releasing of a product are short, the pivot movement must be performed at a high speed. The movement amplitude between the clamping position and the release position of the gripper should be as small as possible in order to keep strong accelerations, which stress the material, within limits.

To prevent damage to a trailing end of a piece of flat material, which trailing end is maintained on the cylinder by a gripper, and which possible damage may be caused by the movement of a gripper which, in the course of clamping a following piece of flat material, which piece of flat material follows in the circumferential direction of the cylinder, most gripper cylinders are laid out for picking up pieces of flat material which are fed to the gripper cylinder spaced apart from each other. The spaced apart pieces of flat material respectively each come to rest against the gripper cylinder while forming a gap between successive pieces. The gripper can thus move in the gap, without touching the respectively previous piece. If these pieces of flat material were previously produced by being cut off a continuous web, in order to form such a gap, the cut-off pieces must be accelerated to a speed which is greater than that of the continuous web, prior to its being cut. However, if a conveying system, which conveys the products cut off the continuous web further after such cutting, runs faster than the fed-in continuous web, this results in slippage. Such slippage results in friction between the conveying system and a leading section of the continuous web penetrating it which continuous web, prior to its being cut off, necessarily still moves at the original speed of the continuous web of which it is a part. In connection with flat material which have a sensitive surface, such as, for example freshly printed products, this friction can impair the quality of the surface, for example by the imposition of drag marks or of smudging of the ink. Moreover, if the pieces of flat material are put together from a stack of sheets, which sheets are not connected with each other, the problem arises that different friction between different sides of the stack can lead to the sheets being displaced with respect to each other, and the stack being pulled apart. Such displacement makes the further processing of the stack considerably more difficult.

It is particularly problematical if the pieces of flat material are cut off from the continuous web when these pieces are in direct contact with the gripper cylinder, such as, for example, by the use of a rotating cutter cylinder which, together with the gripper cylinder, defines a cutting gap, and which rotating cutting cylinder severs the continuous web while working together with a counterthrust element of the gripper cylinder. To insure that the continuous web to be cut is placed evenly against the surface of the gripper cylinder, the gripper must be capable of being lowered into, or of dipping into the interior of the gripper cylinder. After a piece of flat material has been cut off from the fed-in continuous web, there is only a brief period of time which is available for accomplishing the gripping of a freshly formed leading edge of the continuous web, by the use of a gripper, and the pressing of this freshly formed leading edge against the surface of the cylinder. However, the path between the lowered position of the gripper and the extended position of the gripper, in which extended position the gripper presses the flat material against the cylinder, is long and requires a high speed of the gripper movement, which high speed of movement can only be realized by the use of a high quality expensive drive mechanism. Moreover, increasing wear, and therefore susceptibility to failure, of the drive mechanism becomes higher, the greater the operating speed becomes.

A gripper cylinder is known from EP 0 931 748 B1 and from DE 198 57 507 A1, which is capable of conveying printed products, that are cut off a fed-in continuous web, without a lead, i.e. without a space between the successive printed products. In this gripper cylinder, a gripper is mounted on a shaft, which shaft is pivotably seated, via a translation mechanism, in the cylinder, and which drives the gripper, that is coupled to the pivot movement, to perform a parallel displacement. This translation mechanism is used to displace the gripper between its lowered position and a position in which the gripper is projecting past the shell face of the cylinder, from which projecting position, the gripper can be pivoted around the shaft in order to press the leading edge of a continuous web of printed products against the cylinder surface.

DE 100 60 713 A1, U.S. Pat. Nos. 6,093,139 A and 953,063 A each describes a folding apparatus with a gripper cylinder having a cutter strip for engagement by a cutter of a cutter cylinder, which is working together with the gripper cylinder. The grippers of the gripper cylinder are pivotable, around a first, movable shaft, for clamping the material to be transported. This first shaft is, in turn, seated on a lever, which lever is pivotable around a second shaft that is fixed in place on the cylinder. This lever is controlled, with the aid of a first cam disk, for providing a movement of the gripper in the cylinder circumferential direction. A second cam disk controls the clamping movement of the gripper.

DE 102 03 059 A1 discloses a transport cylinder with a gripper for use in transporting sheets of imprinted material. The gripper can be moved by the use of two pivot shafts, which are fixed in place on the cylinder, and by a further pivot shaft, which further pivot shaft is pivotable around one of the pivot shafts that is fixed in place on the cylinder. Only one cam disk is provided for control.

U.S. Pat. Nos. 5,429,578 and 5,004,451 show folding blade cylinders which work together with tapes for accomplishing the guidance of products.

SUMMARY OF THE INVENTION

The object of the present invention is directed to providing a cylinder of a folding apparatus, including a cylinder body and at least one gripper. A two-stage movement of the at least one gripper takes place with little stress of the mechanical components and with a high degree of accuracy.

In accordance with the present invention, this object is attained by the provision of at least one gripper which can be moved between a position lowered into the interior of a cylinder body, an extended position and a clamping position. A shaft is arranged so that the gripper can make a pivoting movement about it between the lowered and extended positions. A second shaft is used to allow the gripper to move in the circumferential direction of the cylinder. Both of these shafts are fixed to the cylinder. A least one tape, which acts with the cylinder, can be arranged in an area between the cutter cylinder and a folding jaw cylinder.

In a manner that is generally the same as that performed by the gripper cylinder which is known from EP 0 931 748 B1, the gripper cylinder, in accordance with the present invention, makes use of a translatory movement, in addition to the pivot movement, for shortening the movement path or distance between the retracted position and the clamping position of the gripper. In accordance with the present invention the difference is that a mechanism, for use in driving the translation, is not pivotable, together with the gripper, around the pivot shaft of the latter and in this way increases its moment of inertia. Instead, the mechanism shifts the shaft of the gripper as such, in the radial direction. Since the radial lift, which is required for clamping or for releasing the flat material from the gripper cylinder, is small, in comparison to the required movement amplitude of the gripper in the circumferential direction, a small amplitude of the radial shifting movement is sufficient. This small amplitude of radial shifting movement can be generated with a small outlay of energy and with the imposition of little stress on the mechanical components.

If the flat material to be clamped by the gripper is a stack of sheets, it is desirable to avoid a movement component of the gripper in the circumferential direction of the cylinder, at the moment of clamping the stack, so that the stack is not subjected to shear forces during such clamping. The clamping is customarily accomplished only by a pivot movement of the gripper. Accordingly, the exertion of a shearing force on a stack of sheets during such clamping cannot be avoided. However, with the gripper cylinder in accordance with the present invention, it is preferably provided that the first shaft is moved radially inward, in a final phase of the pivot movement, into the clamping position.

A simple and rugged possibility for driving the radial inward movement of the first shaft, into the clamping position, is to mount the first pivot shaft on a first arm, which first arm is pivotable around a second shaft, which second shaft is pivotable, with respect to the cylinder body, so that the radial movement of the first shaft corresponds to a pivot movement of this first arm.

In a manner which is essentially the same as the customary pivot movement of the gripper itself, this pivot movement of the first arm can be driven, in a simple manner, by a cam disk, which cam disk does not rotate together with the gripper cylinder and whose shape is traced by a lever that is connected with the first arm.

A coupling rod is provided for driving the pivot movement of the gripper between the lowered position and the clamping position. One end of this coupling rod is hinged on the gripper and the other end is hinged on a second arm, which second arm is pivotable around a third shaft. As discussed above, pivot movement of this coupling rod can also be driven by a cam disk.

In a space-saving arrangement of the present invention, the second and third shafts are on opposite sides of the gripper, in respect to the circumferential direction of the cylinder.

Of the two arms, the first is oriented more in the circumferential direction. Of the cylinder body. The second arm is oriented more in the radial direction of the cylinder body. In other words, the orientation of the first arm is closer to the cylinder circumferential direction than is that of the second arm, and the orientation of the second arm is closer to the radial direction than is that of the first arm.

A counterthrust element is assigned to each gripper on the cylinder body which counterthrust element, working together with a cutter that is moved together with the gripper cylinder, is used for cutting flat material which is fed to the gripper cylinder and which is then to be grasped by the gripper.

With respect to a direction of rotation of such a gripper cylinder, the gripper is arranged upstream of the counterthrust element which is assigned to it. The surface cross section of the gripper cylinder, against which the gripper presses cut flat material, preferably is the gripper's counterthrust element itself, and whose elasticity aids in the cutting process, as well as in the gripping process.

BRIEF DESCRIPTION OF THE DRAWINGS

A preferred embodiment of the present invention is represented in the drawings and will be explained in greater detail in what follows.

Shown are in.

DESCRIPTION OF THE PREFERRED EMBODIMENT

Figure 1:
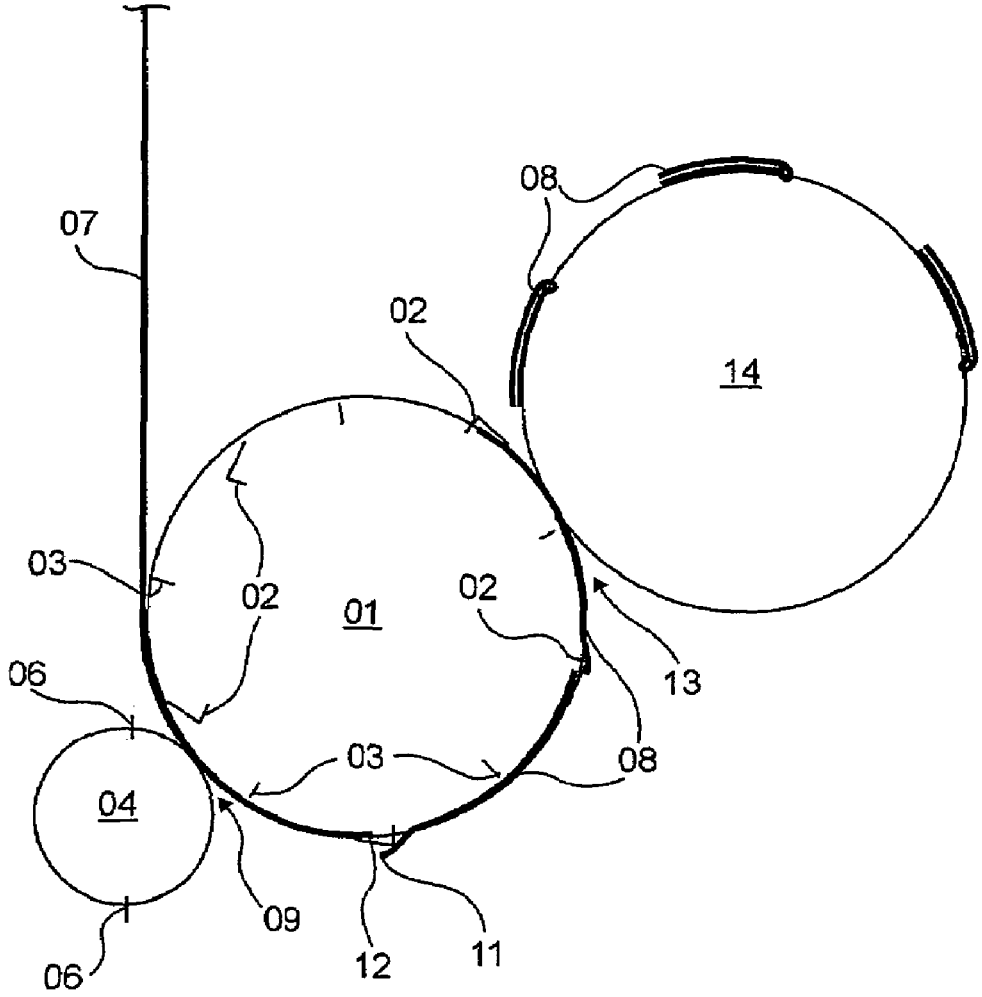
FIG. 1, a schematic side elevation representation of a transverse folding apparatus utilizing a gripper cylinder, in FIG. 2, an enlarged, partial sectional view through the gripper cylinder, and which shows a gripper in its lowered position in the gripper cylinder, in FIG. 3, a partial sectional view analogous to that in FIG. 2, and which shows gripper in the course of the gripper being moved from its lowered position, in FIG. 4, a partial sectional view showing the gripper in a clamping position, in FIG. 5, a partial sectional view showing the gripper during its return travel to its lowered position, in FIG. 6, a schematic representation corresponding to FIG. 2, in FIG. 7, a schematic representation corresponding to FIG. 4, in FIG. 8, a schematic representation corresponding to FIG. 5, in FIG. 9, a schematic representation corresponding to FIG. 1, and in FIG. 10, a schematic view from above on a gripper cylinder in accordance with the present invention.

A greatly simplified, cross-sectional view through a folding apparatus, such as, for example a folding apparatus of a web-fed rotary printing press in accordance with the instant invention, is represented in FIG. 1. The folding apparatus includes a cylinder 01, for example a gripper cylinder 01 which, in the example represented here, is equipped with five grippers 02, which grippers 02 are evenly distributed in the circumferential direction of cylinder 01, and with folding blades 03. A plurality of these grippers 02 are arranged, for example, individually supported in the axial direction of the cylinder 01. A cutter cylinder 04, which is depicted here with two cutters 06, cooperates with the gripper cylinder 01 and constitutes a cutting gap 09. A flat material 07, such as, for example, a continuous web 07, which web 07 is generally composed of a plurality of imprinted webs of material placed on top of each other, such as, for example paper webs, is fed into the cutting gap 09 and is separated into individual flat materials 08, such as, for example, individual printed products 08, each individual printed product 08 having a length corresponding to a printed page.

In the course of their respective passing through the cutting gap 09, the grippers 02 and the folding blades 03 have each been lowered into the interior of the gripper cylinder 01. The circumferential speed of the gripper cylinder 01 corresponds exactly to the feeding speed of the continuous web 07. The printed products 08, which are cut off the continuous web 07, follow each other, without gaps, on the circumference of the gripper cylinder 01. There is thus no relative movement between the lower or inner surface of the web of material and the surface or barrel of the gripper cylinder 01.

"Exactly" and "no" should be understood in the technical sense. In other words, negligible tolerances can possibly occur.

Following their passage through the cutting gap 09, each of the grippers 02 is respectively moved out of the gripper cylinder 01 below or beneath the trailing section 11 of a previously gripped one of the printed products 08 now carried on the gripper cylinder 01 and is pivoted in a direction of rotation which is opposite to that of the gripper cylinder 01 in order to clamp the newly formed leading edge 12 of the continuous web 07 against the surface of the gripper cylinder 01. The trailing ends 11 of each printed product 08 are spaced away, at a finite distance, from the surface of the gripper cylinder 01. However, this trailing end displacement does not hamper the even winding of the continuous web 07 on the gripper cylinder 01, since these trailing ends 11 are only spaced away from the gripper cylinder 01 after having been cut off from the continuous web 07.

The gripper cylinder 01 constitutes a folding gap 13 in cooperation with a folding jaw cylinder 14. In the course of their passage through the folding gap 13, the folding blades 03 carried by the gripper cylinder 01 are moved out of the gripper cylinder 01 to thereby insert the printed products 08, along a transverse center line, into folding jaws, which are not specifically represented, of the folding jaw cylinder 14. The printed products 08, which are transversely folded in this way, are further conveyed on the folding jaw cylinder 14 to a location where they are transferred, for example, to a bucket wheel for delivery onto a conveyor belt, both of which are not specifically represented.

Figure 2:
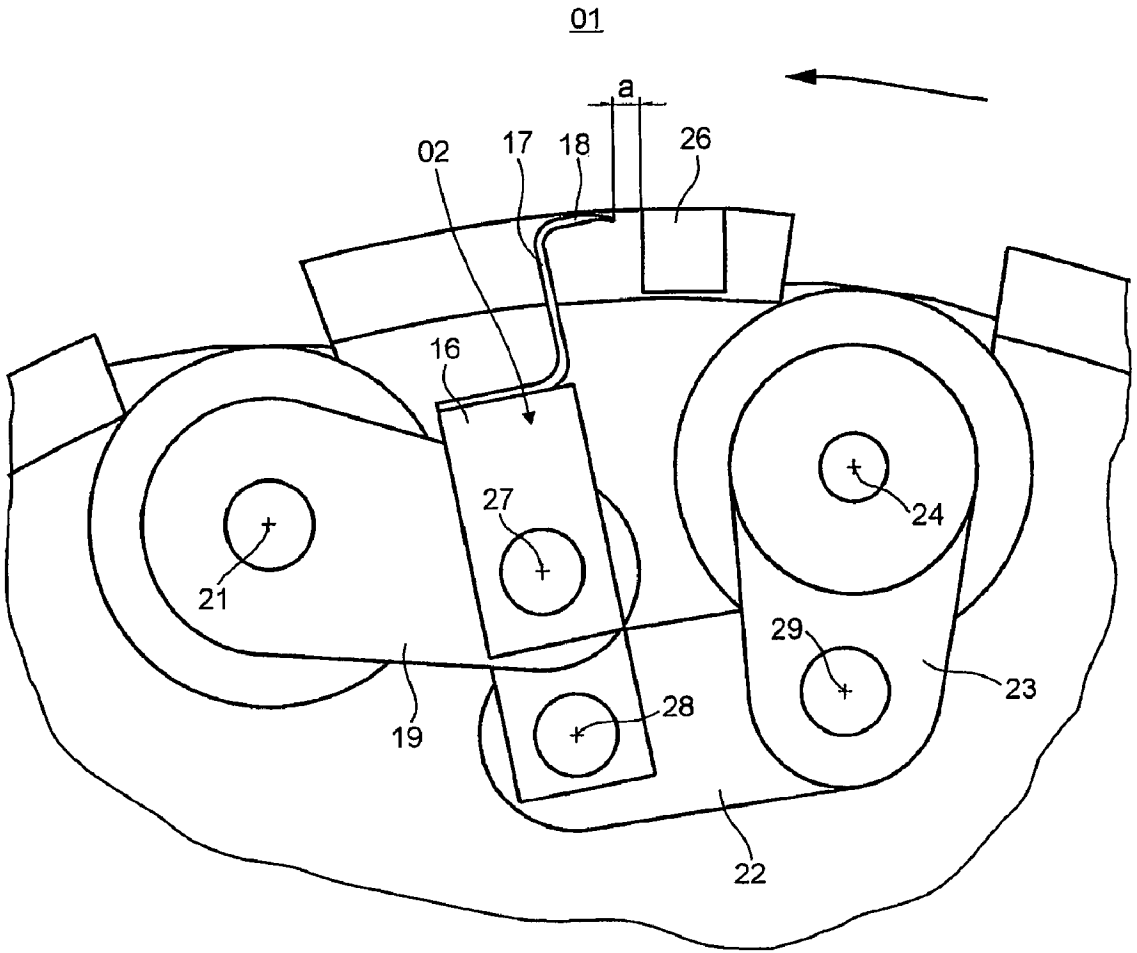

In a partial sectional representation, which is taken transversely in respect to the gripper cylinder 01, FIG. 2 shows a gripper, generally at 02, and its surroundings. The gripper 02 includes a support beam 16, which extends over the entire usable width of the gripper cylinder 01. A double-L or double-Z profiled element 17, that may be made of an elastic material, such as spring steel, is located on a radially outward directed side of support beam 16. The profiled element 17 can be extended out from cylinder 01 for clamping the printed products in place on the surface of cylinder 01. The profiled element 17 can extend continuously in the axial direction of the gripper cylinder 01. Alternatively, it can be divided into a plurality of tines that are spaced apart in the axial direction, which plurality of tines respectively each extend through an opening in the shell face of the gripper cylinder 01.

Figure 6:
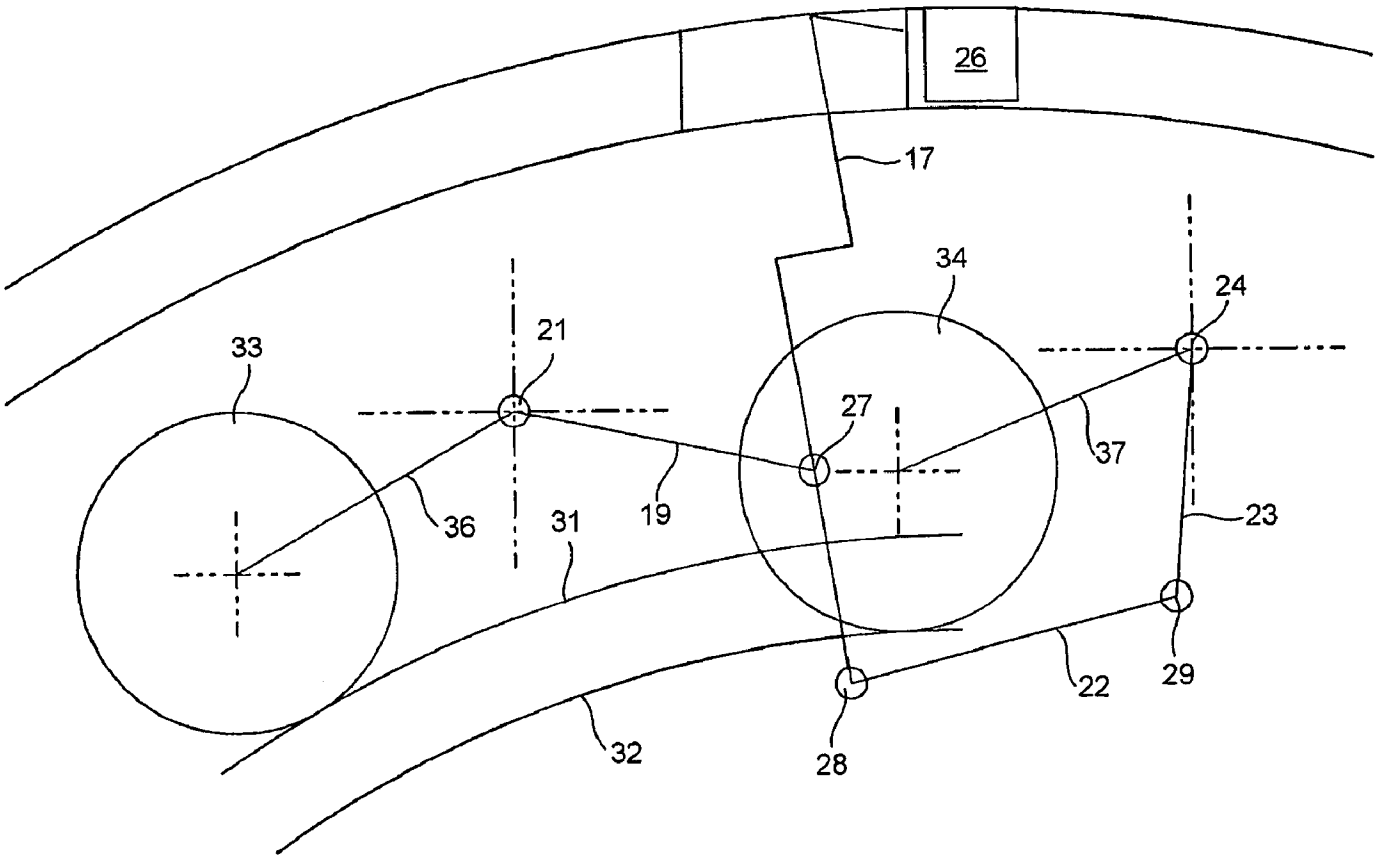
Figure 7:
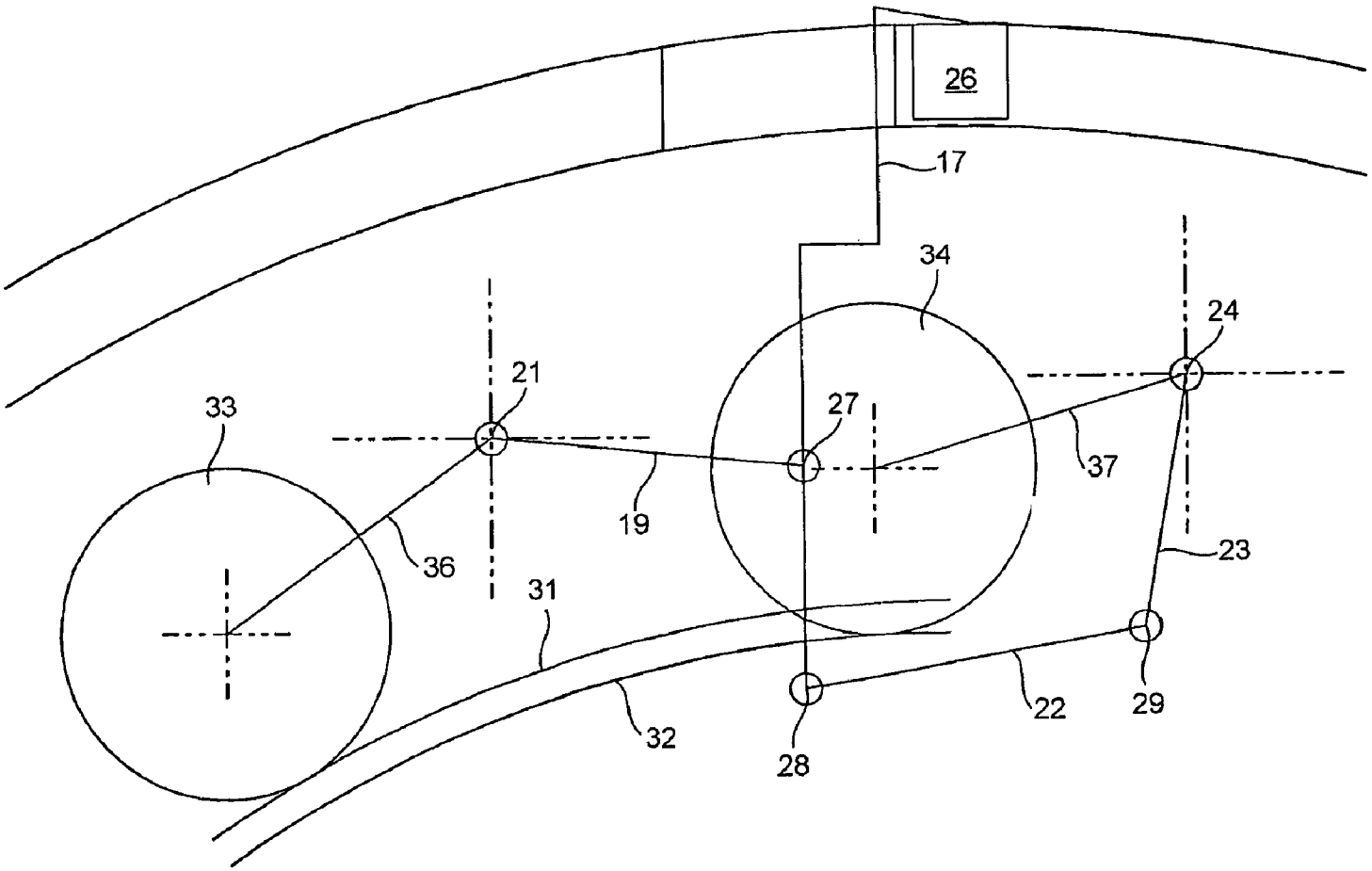
Figure 8:
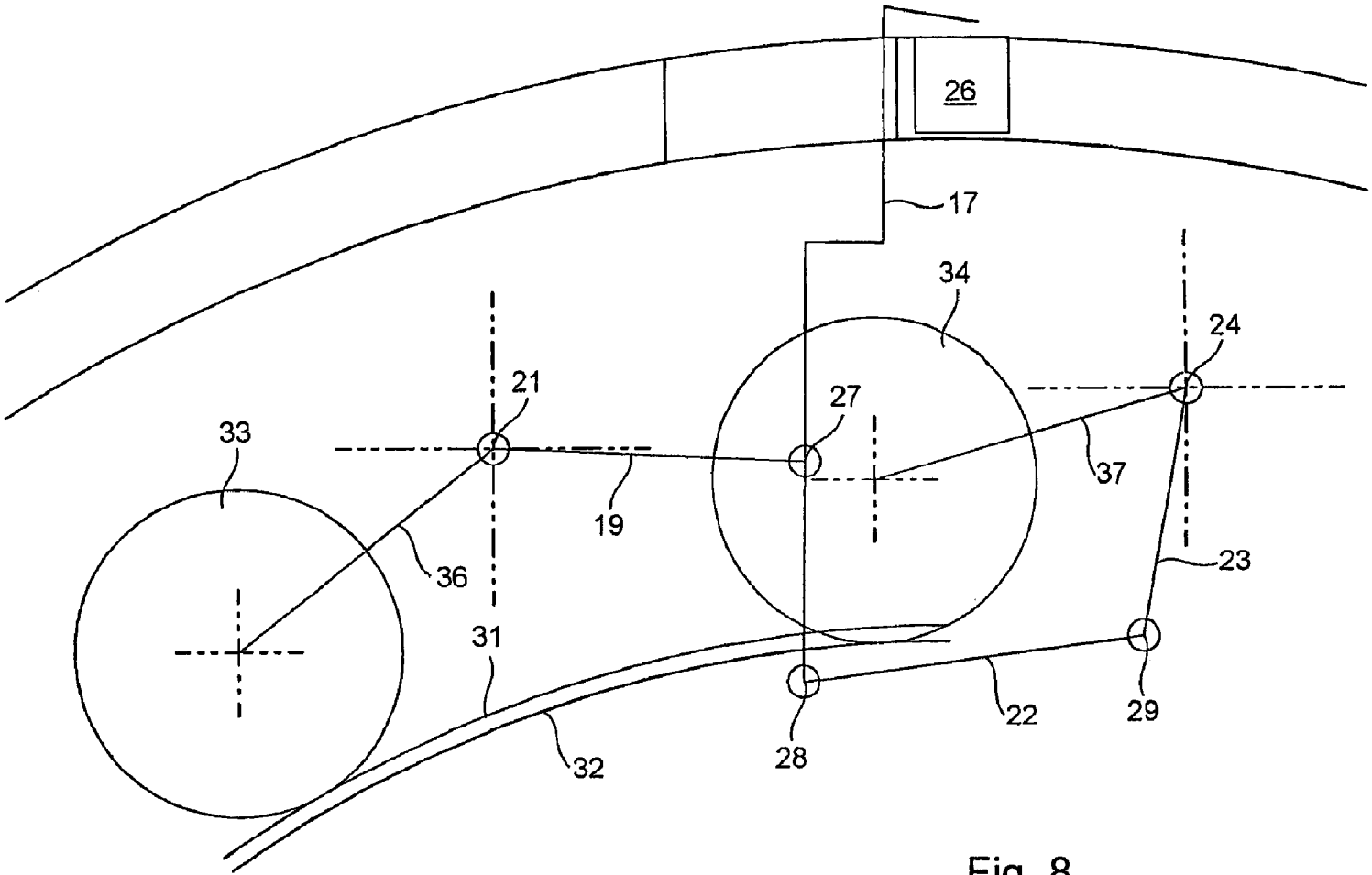

A lower, first end of the support beam 16 is hinged to a first end of a first arm 19, which has a second end that is fixedly connected with a first shaft 21, which first shaft 21 is rotatably supported in the gripper cylinder 01, but which is stationary in the cylinder. In other words, the first shaft 21 can rotate in the cylinder 01 about its longitudinal axis but can not be displaced or repositioned in the body of cylinder 01. The first arm 19 extends approximately parallel to the shell face of the gripper cylinder 01. The lower end of the support beam 16 is furthermore hinged, through a lower extension, and by a first pivot shaft 28, whose position relative to the gripper cylinder 01 can be changed, to a coupling rod 22. The coupling rod 22 is also oriented approximately parallel to the shell face of the gripper cylinder 01. Coupling rod 22 is itself hinged, by a second pivot shaft 29, whose position relative to the gripper cylinder 01 can also be changed, to an approximately radially oriented second arm 23. This second arm 23 is fixedly connected with a second shaft 24, which second shaft 24 is rotatably seated in the gripper cylinder 01. The various rotated position of the two arms 19, 23 is, as represented in FIGS. 6, 7 and 8, are determined by two cam disks 31, 32, as seen in FIGS. 6-8 and 10 and which do not rotate together with the gripper cylinder 01 which cam disks 31, 32 are traced by respective rollers 33, 34, which rollers 33, 34 are each connected by an arm 36, 37 with the shaft 21 or 24, respectively.

The rollers 33, 34 are preferably resiliently pressed against the cam disks 31, 32, in particular by the use of a torsion spring. The cam disks 31, 32 are arranged offset in the axial direction with respect to each other, and with respect to the gripper cylinder 01.

It may be seen, by referring to FIG. 2, that a rotation of the first arm 19 around the first shaft 21 substantially causes a radial inward or outward movement of the gripper 02, and also causes, at most to a lesser degree, a pivot movement of the gripper 02 around a third pivot shaft 27 to which both the support beam 16 and the first arm 19 are hinged. A rotation of the second shaft 24 would, with the first shaft 21 assumed to be fixed, result in a pivot movement of the gripper 2 around the third shaft 27.

Therefore, a two-stage movement of the gripper 02 is possible by use of the two cam disks 31, 32. The cam disks 31, 32 have the effect that the pivot movement and the clamping movements of the gripper 02 can each take place substantially independently of the other.

The gripper cylinder 01, as represented in part in FIG. 2, rotates in a counterclockwise direction. A hard rubber strip or counterthrust element 26, which includes a surface section, has been inserted in the cylinder shell and is located, in a clockwise direction of the cylinder shell, behind the opening in the cylinder shell receiving the profiled element 17. This rubber strip 27 is used, for example, as a counterthrust element 26, extending in the axial direction, for engagement by the cutter 06 of the cutter cylinder 04 when that cutter 06 is cutting the continuous web 07. In the movement direction of the cylinder 01, the gripper 02 is arranged directly in front of, or before, the counterthrust element 26, which is provided for cutting. A distance "a" between a tip of the gripper 02 in its lowered state, as seen in FIG. 2, and of an edge of the counterthrust element 26 is less than 30 mm, and in particular is less than 10 mm. In the configuration represented in FIG. 2, in which the gripper 02 has been lowered into the interior of the gripper cylinder 01, the gripper 02 can pass through the cutting gap 09, wherein the continuous web 07, which is not represented in FIG. 2, is cut through at the height, or the location of the counterthrust element 26. To accomplish the grasping of the leading edge 12 of the continuous web 07 which is being formed in the cutting process, and to push it against the counterthrust element 26, the gripper 02 is moved out of the gripper cylinder 01.

Figure 3:
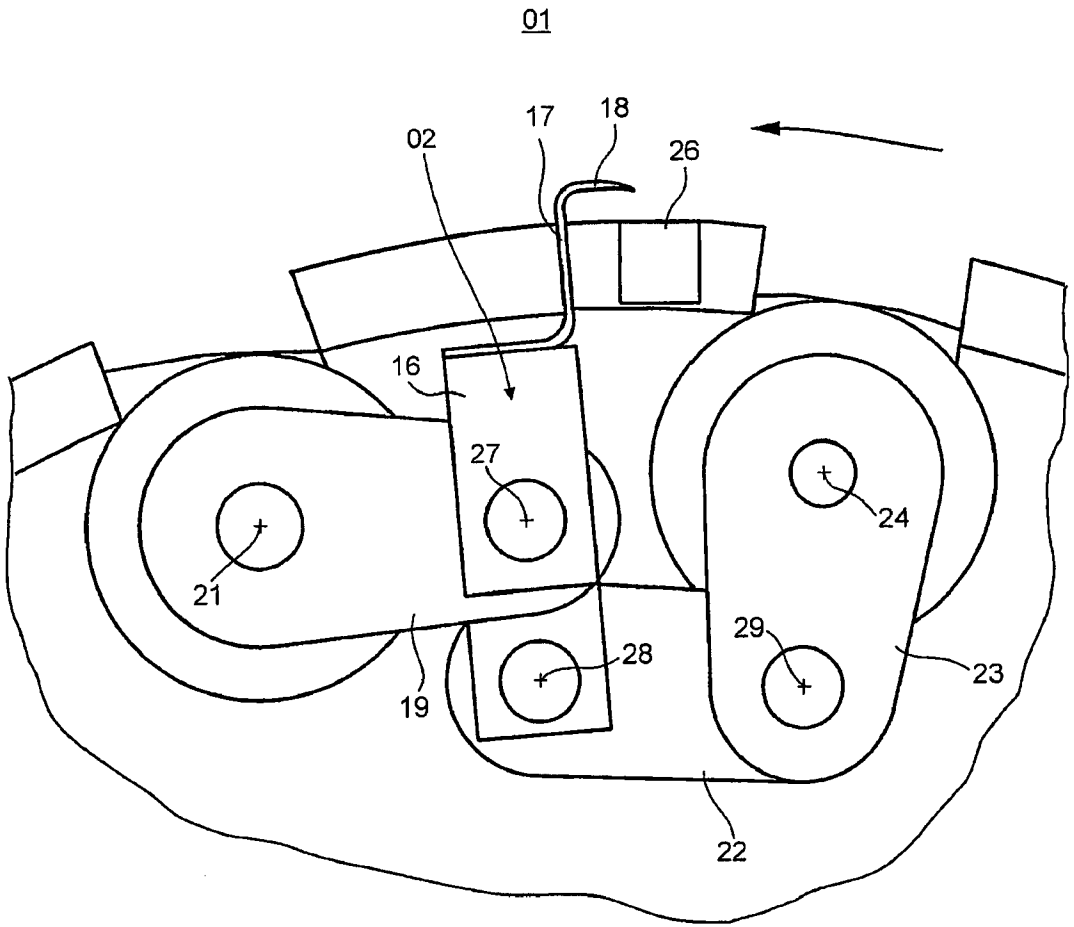

FIG. 3 shows an intermediate position in the course of the gripper's moving-out process. As can clearly be seen, the first shaft 21 has been rotated in a counterclockwise direction between the configuration of FIGS. 2 and 3. As a result of this rotation, the third pivot shaft 27 has been displaced radially outward and the profiled element 17 of the gripper 02 has risen through the opening in the cylinder shell. As a result of a slight turning of the second shaft 24 in the clockwise direction, the gripper 02 has furthermore been pivoted around the third pivot shaft 27 in a clockwise direction, so that the tip of the free leg 18 of the profiled element 17 is located radially above the counterthrust element 26.

Figure 4:
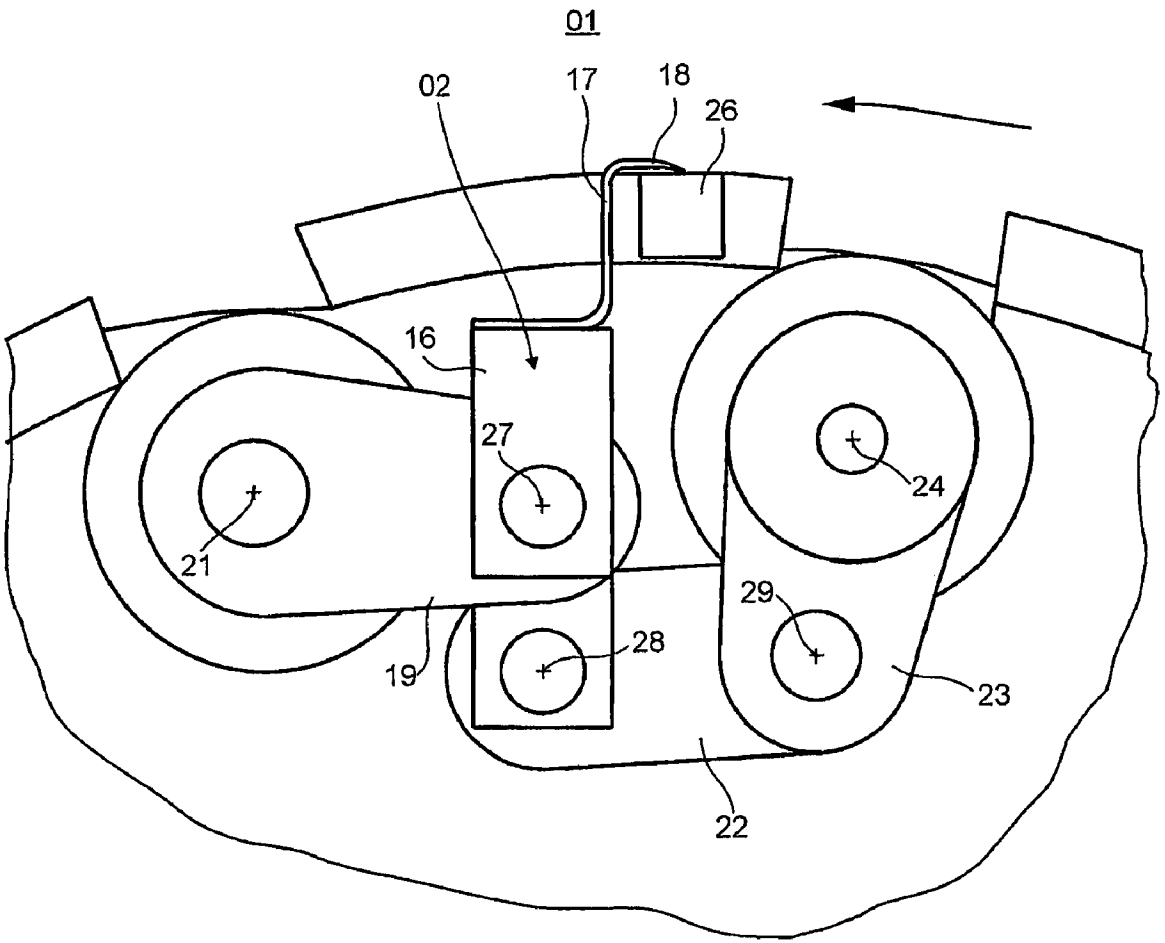

As represented in FIG. 4, the third pivot shaft 27 of the gripper 02 is again radially displaced into the interior of the gripper cylinder 01 by a rotation of the first shaft 21 in a clockwise direction, so that the free leg 18 of the profiled element 17 is lowered onto the counterthrust element 26. This clamps the leading edge of the continuous web 07, which is not represented in FIG. 4, and which is located between free leg 18 and the counterthrust element 26, between the two.

Figure 5:
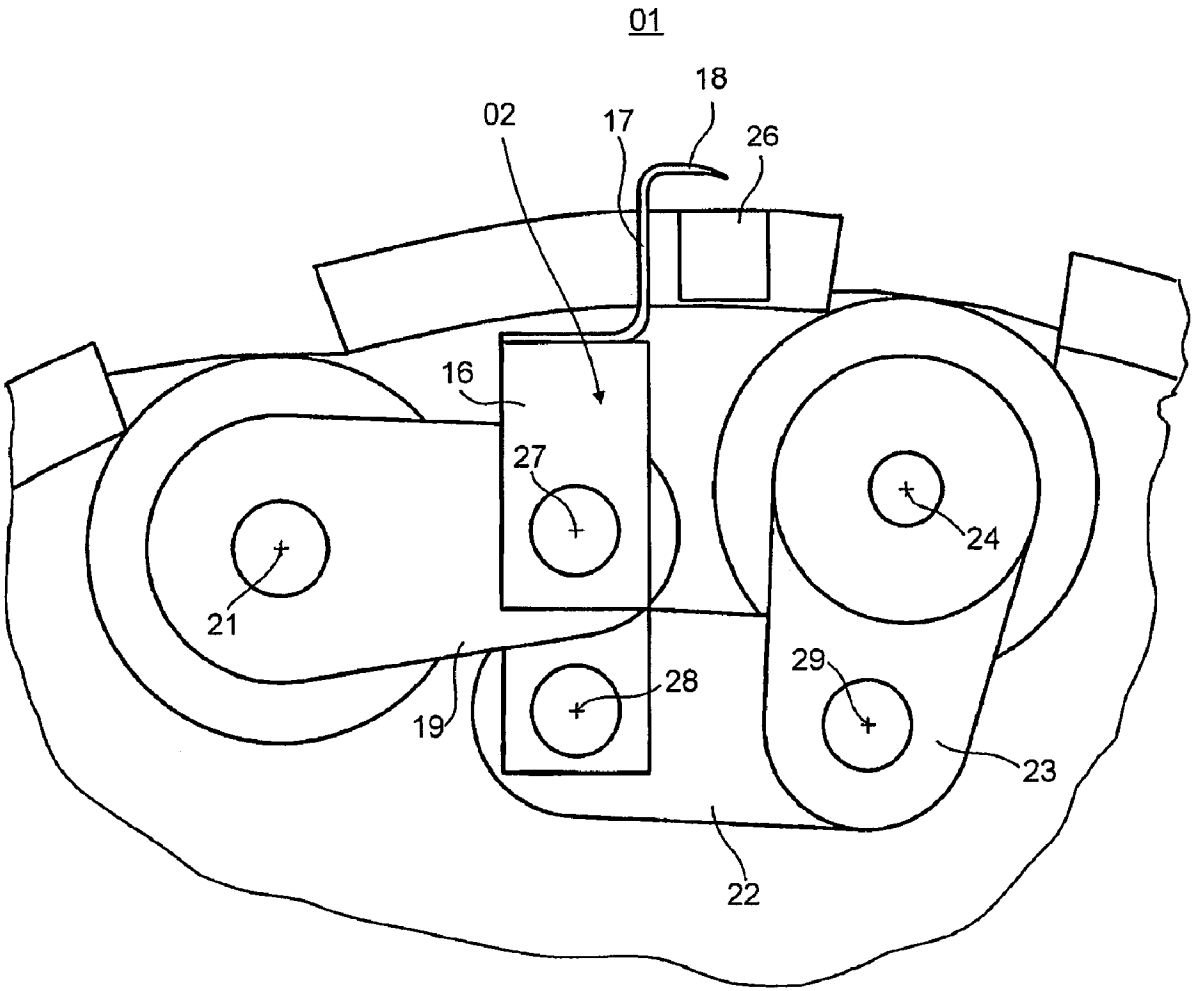

Following the passage of the gripper 02 through the folding gap 13, as seen in FIG. 1, the gripper 02 is raised again by a rotation of the first shaft 21 in a counterclockwise direction. The printed product 08, clamped between the gripper free leg 18 and the counterthrust element 26, is released, as shown in FIG. 5. The first shaft 24 now pivots in a counterclockwise direction in order to pull the gripper 02 over the counterthrust element 26 and over the opening in the cylinder shell. By the imposition of a subsequent rotation of the first shaft 21 in a clockwise position, the gripper 02 is again pulled back into the interior of the gripper cylinder 01 and into the position indicated in FIG. 2. The gripper 02 is now ready for a further passage through the cutting gap 09.

As can be seen, a narrow pivot angle of the gripper 02 is sufficient to move it between the clamping position and the lowered position. The radial lift of the gripper 02 is also limited, depending on the thickness of the printed products 06 to be processed, to a few millimeters. Since the gripper 02 can be constructed in a simple manner, its weight and moment of inertia are low. The short lifts which are traveled between the lowered position and the clamping position of the gripper 02 require small accelerations and therefore require only reasonable, material-saving driving forces.

Figure 9:
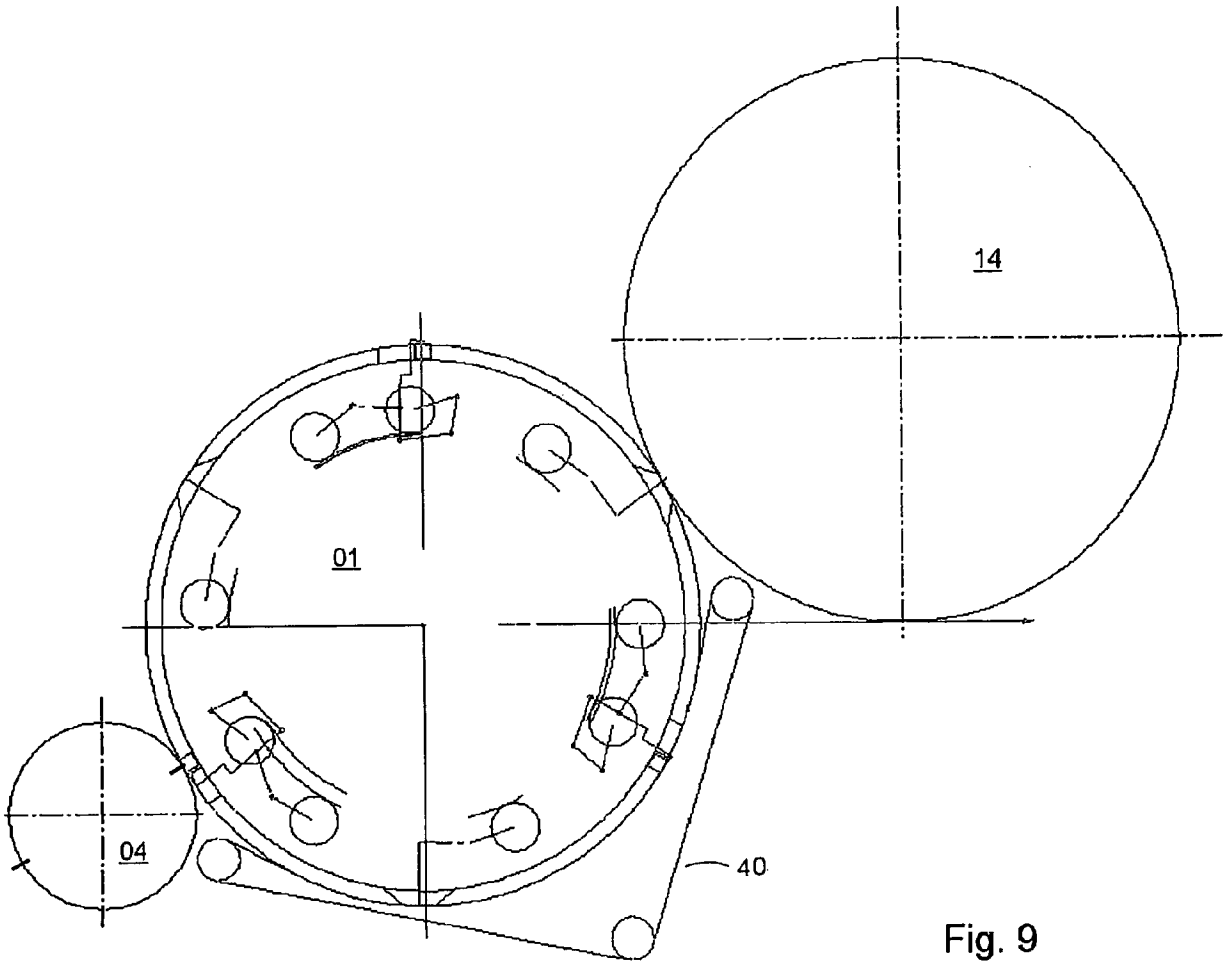

FIG. 9 shows a gripper cylinder 01 with three gripper systems 02, such as, for example, three grippers 02. The gripper system 02, which is located in the area of the cutter cylinder 04, is in the lowered position, i.e. in the cutting position. The gripper system 02, which is located in the area between the cutter cylinder 04 and the folding jaw cylinder 14, is in the closed position, i.e. in the clamping position. The gripper system 02, which is arranged downstream of the folding jaw cylinder 14, is in the opened position, i.e. in the release position.

A tape guide 40, as also seen in FIG. 9, can additionally be arranged between the cutter cylinder 04 and the folding jaw cylinder 14. Tapes, which form tape guide 40, press the cut-off printed products 08, i.e. the signatures, against the shell face of the gripper cylinder 01. Several tapes are arranged to be spaced apart in the axial direction, so that the grippers 02 can run without interference in these spaces formed between the several tapes.

The tape guide 40 can be driven from either the gripper cylinder 01 or the folding jaw cylinder 14. The tape guide 40 can also be driven by frictional connection or by its own separate motor.

Figure 10:
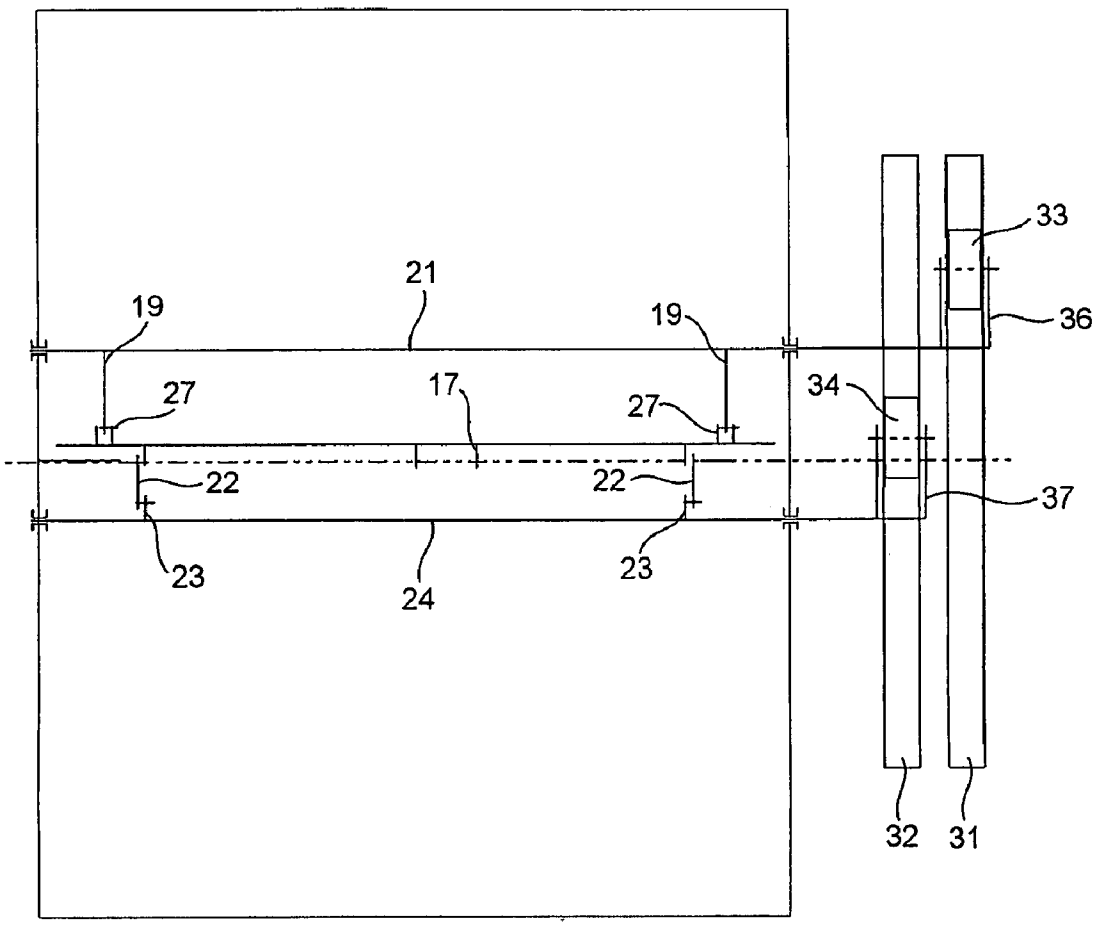

FIG. 10 shows a schematic view from above of a gripper system 02 in accordance with the present invention.

While a preferred embodiment of a cylinder pertaining to a folder and comprising a cylinder body and at least one gripper, in accordance with the present invention, has been set forth fully and completely hereinabove, it will be apparent to one of skill in the art that various changes in, for example the type of printing press used to print the continuous web, the specific drives for the cylinders and the like could be made without departing from the true spirit and scope of the present invention which is to be limited only by the following claims.

The invention claimed is:

1. A cylinder of a folding apparatus comprising:

a cylinder body including a cylinder body interior and a cylinder body surface and being rotatable in a direction of rotation about a cylinder body axis of rotation;

at least one gripper supported by said cylinder body for movement between at least a lowered position within said cylinder body interior, an extended position and a clamping position;

a counterthrust element located on said cylinder surface and adapted to cut flat material to be grasped by said at least one gripper, said counterthrust element being assigned to said gripper, said gripper being located before, in a direction of rotation of said cylinder body, said counterthrust element;

a gripper tip adapted to press the flat material against said counterthrust element in said clamping position;

a first shaft in said cylinder body, said gripper being pivoted about said first shaft for movement between said lowered position and said extended position;

a first arm pivotable about said first shaft;

a first pivot shaft supported by said first arm, said first pivot shaft being movable radially in said cylinder body; and a second shaft having a second shaft axis of rotation different from said cylinder body axis of rotation, said gripper being moved with respect to said second shaft in a circumferential direction of said cylinder body.

2. The cylinder of claim 1 wherein said first shaft and said second shaft are fixed in place in said cylinder body.

3. The cylinder of claim 1 further including a cutter cylinder and a folding jaw cylinder spaced at a distance from each other about said cylinder body surface, and at least one tape guide adapted to engage said cylinder body surface in an area between said cutter cylinder and said folding jaw cylinder, and wherein, in said lowered position, said gripper tip is located at a distance of less than 30 mm from said counterthrust element.

4. The cylinder of claim 3 wherein said distance is less than 10 mm.

5. The cylinder of claim 1 wherein said first pivot shaft moves radially inwardly during movement of said gripper into said clamping position.

6. The cylinder of claim 1 further including a first cam disk connected to said first pivot shaft.

7. The cylinder of claim 1 further including a coupling rod having a first end connected to said gripper, and a second arm which is pivotable about said second shaft, said coupling rod having a second end connected to said second arm.

8. The cylinder of claim 7 further including a second cam disk adapted to pivot said second arm.

9. The cylinder of claim 7 wherein said first arm is oriented generally in a circumferential direction of said cylinder body and said second arm is oriented generally in a radial direction of said cylinder body.

10. The cylinder of claim 1 wherein said cylinder is a folding blade cylinder.

11. The cylinder of claim 1 wherein during cutting of a product, said gripper tip is located directly before said counterthrust element in said movement direction of said cylinder.

12. The cylinder of claim 11 wherein a distance between said gripper tip and said counterthrust element in said lowered position is less than 30 mm.

13. The cylinder of claim 12 wherein said distance is less than 10 mm.

14. The cylinder of claim 1 further including a cutter cylinder and a folding jaw cylinder spaced at a distance from each other about said cylinder body surface, and at least one tape guide adapted to engage said cylinder body surface in an area between said cutter cylinder and said folding jaw cylinder.

* * * * *